US011453144B1

(12) United States Patent
Zhan

(10) Patent No.: US 11,453,144 B1
(45) Date of Patent: Sep. 27, 2022

(54) PORTABLE DOWEL MAKING TOOL

(71) Applicant: Jinhua Wanfeng Tools Factory, Jinhua (CN)

(72) Inventor: Hui Zhan, Jinhua (CN)

(73) Assignee: Jinhua Wanfeng Tools Factory, Jinhua (CN)

( * ) Notice: Subject to any disclaimer, the term of this patent is extended or adjusted under 35 U.S.C. 154(b) by 0 days.

(21) Appl. No.: 17/742,451

(22) Filed: May 12, 2022

(30) Foreign Application Priority Data

Nov. 8, 2021 (CN) ..... 2021113153024

(51) Int. Cl.
*B27M 3/28* (2006.01)

(52) U.S. Cl.
CPC ..... *B27M 3/28* (2013.01)

(58) Field of Classification Search
CPC ..... B27M 3/28; B27G 13/16; B27L 9/00
See application file for complete search history.

(56) References Cited

U.S. PATENT DOCUMENTS 1,668,004 A * 5/1928 Caron ..... B27M 3/28 144/219
6,263,929 B1 * 7/2001 Aziz ..... B27C 5/08 142/29

FOREIGN PATENT DOCUMENTS

DE 102011015565 A1 * 10/2012 ..... B27C 5/08

* cited by examiner

*Primary Examiner* — Matthew Katcoff

(57) ABSTRACT

Disclosed is a portable dowel making tool. The tool includes a base, a dowel positioning portion is arranged on the base, the dowel positioning portion is provided with a dowel passing hole for a dowel to pass through, and the base or/and the dowel positioning portion is/are provided with a cutting mechanism which matches the dowel passing hole so as to cut, when a material rotates, the material into a cylinder capable of passing through the dowel passing hole. According to the present disclosure, by arranging the dowel positioning portion on the base and by arranging the cutting mechanism at the dowel positioning portion, a log can be conveniently cut to obtain the regular dowel without tools such as a lathe such that the dowel can be machined more conveniently. The tool can match various rotatable components to machine the dowel, such that machining is more convenient.

18 Claims, 12 Drawing Sheets

PORTABLE DOWEL MAKING TOOL

TECHNICAL FIELD

The present disclosure relates to the technical field of machining tools, in particular to the technical field of portable dowel making tools.

BACKGROUND ART

As one of the common assembly and connection fittings of log-based panel type furniture in modern times, a dowel in a cylinder shape is generally made of log. In actual use, the dowel is used for positioning and fixing. The dowel generally matches furniture eccentric fittings, which play a fixing role, when used for positioning. Interference fit, double-sided gluing and other methods are generally used when the dowel is used for fixation and combination. Before the dowel is used, the corresponding position of a workpiece to be connected is punched in two directions, the hole or the dowel is coated with glue, and then the dowel is driven into the hole, and the workpiece is pressurized, such that connection is completed after the glue is cured.

The dowel is usually machined by means of turning by equipment such as a lathe. For example, China utility model patent with patent number of CN 2037657330 provides a machine for machining a wooden stick, where a machining tool is fixed at an axis of a three-claw disc, a material passing hole matching a diameter of the wooden stick is provided at a center, tool teeth are arranged at a front end, a pair of feeding clamping rollers are provided with 90-degree V-shaped grooves, are positioned at the front end of the machining tool and are used for conveying the wooden stick to be machined, material shifting wheels are positioned at a rear end of the machining tool and used for outputting the machined wooden stick, and material supporting frames for supporting the wooden stick to be machined and the machined wooden stick are arranged at front ends of the feeding clamping rollers and rear ends of the material shifting wheels respectively. However, this kind of equipment is high in cost and inconvenient in machining, and has certain professional requirements on machining personnel, such that machining cost and threshold are high. In addition, the equipment is inconvenient to carry due to large size, and thus cannot be carried to the site for machining.

SUMMARY

The objective of the present disclosure is to provide a portable dowel making tool, so as to solve the problems in the prior art. The tool is convenient to carry and may match equipment such as an electric drill to make a dowel such that the dowel may be conveniently made, making accuracy is improved and cost is saved.

In order to realize the above objective, the present disclosure provides a portable dowel making tool. The tool includes a base, a dowel positioning portion is arranged on the base, the dowel positioning portion is provided with a dowel passing hole for a dowel to pass through, and the base or/and the dowel positioning portion is/are provided with a cutting mechanism which matches the dowel passing hole so as to cut, when a material rotates, the material into a cylinder capable of passing through the dowel passing hole. The cutting mechanism includes several positioning portion cutters which are arranged on the dowel positioning portion and arranged around the dowel passing hole; or/and cutters which are arranged on the base and face a periphery of the dowel passing hole and cutter fixing portions for fixing and adjusting positions of the cutters.

Preferentially, cutter fixing grooves facing a dowel passing hole end are provided in the cutter fixing portions, the cutters are movably arranged in the cutter fixing grooves, cutting edge ends of the cutters may extend out from ends, close to the dowel passing hole, of the cutter fixing grooves, and cutter locking members which abut against and match the cutters in the cutter fixing grooves are arranged on the cutter fixing portions.

Preferentially, adjusting bolts for driving the cutters to move towards the ends close to the dowel passing hole are arranged on the cutter fixing portions, elastic member cavities in communication with the cutter fixing grooves are provided in the cutter fixing portions, and first elastic members for driving the cutters to move along the cutter fixing grooves towards ends away from the dowel passing hole are arranged in the spring cavities.

Preferentially, end covers matching the cutter fixing grooves are detachably arranged at the ends, away from the dowel passing hole, of the cutter fixing portions, end cover fixing inserted pins and end cover fixing insertion holes which mutually match in an insertion manner are arranged on the end covers and the cutter fixing portions respectively, and arrangement directions of the end cover fixing inserted pins are perpendicular to or nearly perpendicular to elastic force directions of the elastic members.

Preferentially, cutting edges of the cutters are inclined relative to an axis of the dowel passing hole.

Preferentially, a positioning portion fixing hole for carrying the dowel positioning portion is provided on the base, the dowel positioning portion is detachably arranged in the positioning portion fixing hole, a dowel positioning portion limiting flange is arranged at one end, close to the cutters, of the dowel positioning portion, and a limiting groove matching the dowel positioning portion limiting flange is arranged at one end, close to the cutters, of the positioning portion fixing hole.

Preferentially, a locking mechanism for fixing the dowel positioning portion in the positioning portion fixing hole is arranged on the base. The locking mechanism includes a positioning portion locking hole in communication with the positioning portion fixing hole, and a bolt which abuts against and matches a side edge of the dowel positioning portion may be arranged in the positioning portion locking hole; or the locking mechanism includes a lock pin and a switch in control connection to the lock pin, a pin hole adapted to the lock pin is transversely provided in the base, the pin hole is in communication with the positioning portion fixing hole, the lock pin is slidably arranged in the pin hole, the switch is arranged at a position, close to the pin hole, of the base and is used for controlling the lock pin to slide towards an end away from or close to a dowel cutting member end, and an insertion hole adapted to the lock pin is provided on a side wall of the dowel cutting member.

Preferentially, the switch is slidably arranged on the base, a control chute adapted to the lock pin is provided on one side, close to the lock pin, of the switch, and a protruding block slidably matching the control chute is arranged on one end, close to the switch, of the lock pin. The control chute includes a locking section and a loosening section, and the locking section and the loosening section are connected by means of a slope section. Under the situation that the protruding block matches the locking section, one end of the lock pin extends into the positioning portion fixing hole. Under the situation that the protruding block matches the loosening section, the lock pin is retracted into the pin hole.

Preferentially, several rotary bearings matching the dowel positioning portion are arranged in the positioning portion fixing hole.

Preferentially, positioning grooves are provided on two opposite sides of the dowel passing hole respectively, and a connecting line between the positioning grooves on the two sides intersects an axis of the dowel passing hole.

Preferentially, the tool further includes a fixing plate arranged on the base, a fixing plate accommodating groove matching the fixing plate on the base is provided on the base, and the fixing plate is slidably arranged in the fixing plate accommodating groove.

Preferentially, several fixing plate limiting chutes are provided on the fixing plate, several limiting pins matching the fixing plate limiting chutes are arranged in the fixing plate accommodating groove, and the limiting pins are slidably connected to the fixing plate limiting chutes.

Preferentially, a positioning mechanism which matches the fixing plate so as to position and fix the fixing plate is arranged on the base. The positioning mechanism includes a positioning top ball and a positioning ball elastic driving member, a positioning mechanism mounting cavity in communication with the fixing plate accommodating groove is provided on the base, the positioning top ball and the positioning ball elastic driving member for driving the positioning top ball to move towards a fixing plate accommodating groove end are movably arranged in the positioning mechanism mounting cavity, and several positioning holes matching the positioning top ball are provided on the fixing plate.

Preferentially, punching positioning stop columns are arranged at two opposite corners of the base respectively, and the punching positioning stop columns and the dowel passing hole are arranged in the same straight line.

Preferentially, positioning stop column holes for mounting the punching positioning stop columns are provided on the base, protruding limiting flanges are arranged in the positioning stop column holes, stop column limiting sliding rod sections matching the limiting flanges are arranged on the punching positioning stop columns, stop column flanges matching the limiting flanges are arranged on two ends of each positioning stop column, and the stop column limiting sliding rod sections are slidably connected to the limiting flanges such that the punching positioning stop columns may be accommodated in the positioning stop column holes or may extend out from ends of the positioning stop column holes.

Preferentially, several clamping members for fixing the base are arranged on the base, the clamping members include clamping member fixing blocks arranged on the base and clamping bolts transversely arranged on the clamping member fixing blocks, and the clamping bolts are in threaded connection to the clamping member fixing blocks.

Preferentially, several fixing block mounting cavities which are provided at different positions and match the clamping member fixing blocks are provided on the base, and the clamping member fixing blocks are detachably arranged in the fixing block mounting cavities.

The portable dowel making tool of the present disclosure has the beneficial effects that according to the present disclosure, by arranging the dowel positioning portion on the base and by arranging the cutting mechanism at the dowel positioning portion, a log may be conveniently cut to obtain the regular dowel without tools such as a lathe such that the dowel may be machined more conveniently. The tool may match various rotatable components such as an electric drill to machine the dowel, such that machining is more convenient. The tool is simple in structure, low in cost and more efficient in machining, and end product quality of the dowel is higher. In addition, the tool is small in size and convenient to carry, and therefore may be conveniently used in various workplaces.

The features and advantages of the present disclosure will be described in detail with reference to the embodiments and the accompanying drawings.

DETAILED DESCRIPTION OF THE EMBODIMENTS

Figure 1:
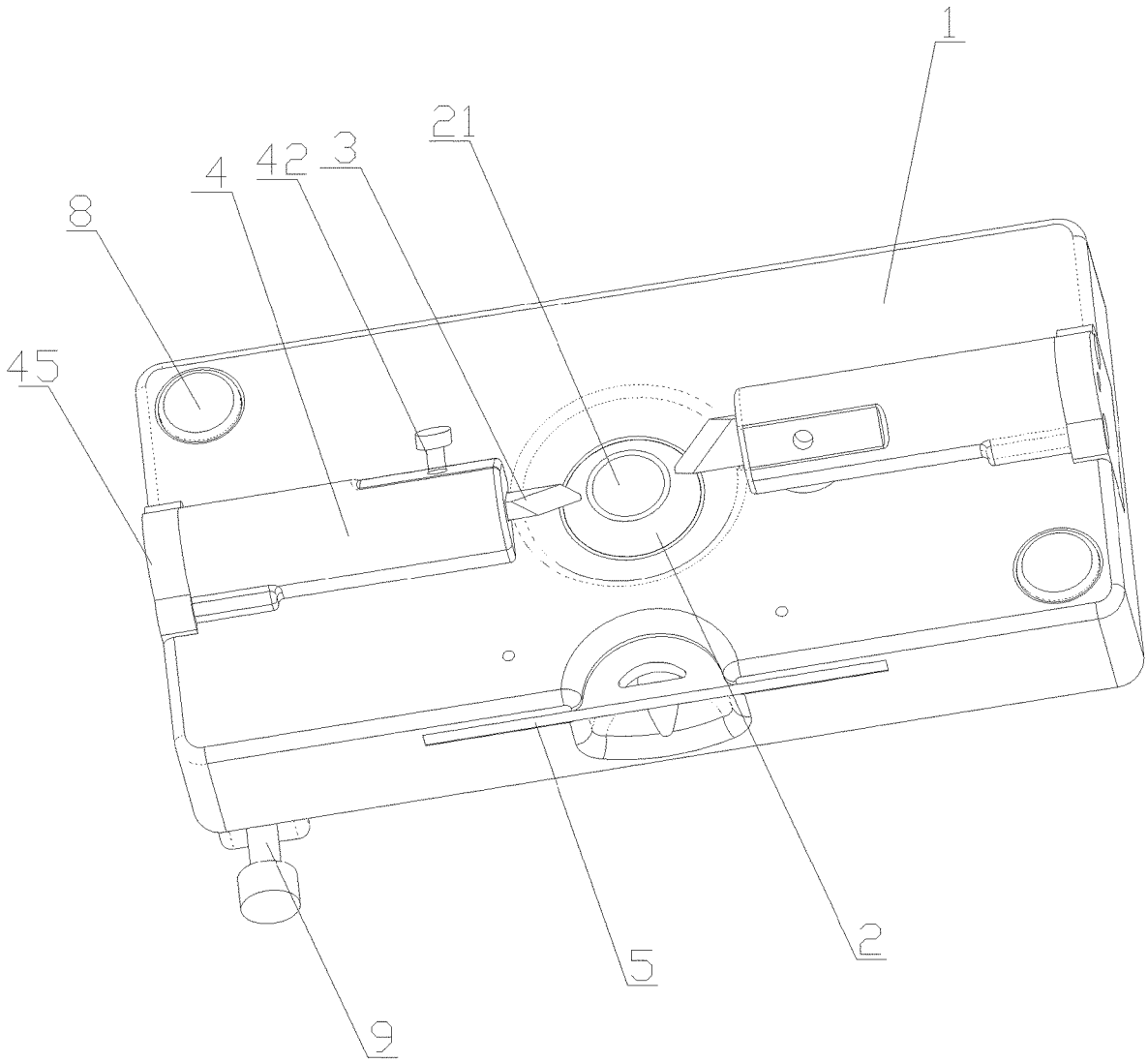
FIG. 1 is a schematic diagram of three-dimensional structures in Embodiments 1, 2, 3 and 4 of a portable dowel making tool of the present disclosure.

For making the objectives, technical solutions and advantages of the present disclosure clearer, the present disclosure will be described in further detail below in conjunction with the accompanying drawings and the embodiments. It should be understood that the specific embodiments described herein are merely illustrative of the present disclosure and are not intended to limit the present disclosure. In addition, in the following descriptions, descriptions of well-known structures and technologies are omitted in order to avoid unnecessarily obscuring the concepts of the present disclosure.

In the descriptions of the present disclosure, it should be noted that when an element is referred to as being "fixed to" or "arranged on" another element, the element may be directly or indirectly on another element. When an element is referred to as being "connected to" another element, the element may be directly or indirectly connected to another element.

In the descriptions of the present disclosure, it should be noted that the terms "center", "length", "width", "thickness", "upper", "lower", "front", "back", "left", "right", "vertical", "horizontal", "top", "bottom", "inner", "outer", etc. indicate orientation or position relations based on those shown in the accompanying drawings, or of common placement when the product of the present disclosure is used, which are only for ease of description of the present disclosure and for simplicity of description, and are not intended to indicate or imply that the referenced device or element must have a particular orientation and be constructed and operated in a particular orientation, and thus may not be construed as a limitation on the present disclosure. Moreover, the terms "first", "second", "third", etc. are used merely to distinguish between descriptions and may not be construed as indication or implication of relative importance. Thus, a feature defined with "first" and "second" may explicitly or implicitly include one or more of the features. In the description of the present disclosure, "a plurality of" means two or more, unless expressly specified otherwise. "Several" means one or more, unless expressly specified otherwise.

In the description of the embodiments of the present disclosure, unless otherwise explicitly specified and defined, the terms "arranged", "mounted", "mutually connected" and "connected to" should be understood in a broad sense. For example, a connection may be a fixed connection, a detachable connection, or an integrated connection; may be a mechanical connection or an electrical connection; may be a direct connection, or an indirect connection via an intermediate medium; or may be communication of interiors of two elements. For those of ordinary skill in the art, the specific meanings of the above terms in the present disclosure could be understood according to specific circumstances.

Embodiment 1

With reference to FIG. 1, FIG. 2, FIG. 3 and FIG. 4, a portable dowel making tool of the present disclosure includes a base 1, a dowel positioning portion 2 is arranged on the base 1, and a dowel passing hole 21 for a dowel to pass through is provided on the dowel positioning portion 2. The base 1 is provided with a cutting mechanism which matches the dowel passing hole 21 so as to cut, when a material rotates, the material into a cylinder capable of passing through the dowel passing hole 21. The cutting mechanism includes cutters 3 which are arranged on the base 1 and face a periphery of the dowel passing hole 21 and cutter fixing portions 4 for fixing and adjusting positions of the cutters 3. In the embodiment, by arranging the dowel positioning portion 2 on the base 1 and by arranging the cutting mechanism at the dowel positioning portion 2, a log may be conveniently cut to obtain the regular dowel without tools such as a lathe. When in use, the log to be cut is fixed on a rotatable driving member, such as an electric drill, an end of the log is aligned with the dowel passing hole 21, and in order to make the end of the log conveniently inserted into the dowel passing hole 21, a tip or a thin rod capable of being conveniently inserted into the dowel passing hole 21 may be machined at the end of the log in advance. The rotatable driving member is started to drive the log to rotate, so as to make a side edge of the log in contact with the cutters 3, then a redundant portion of the log is cut off, and the cut log is in a cylinder capable of passing through the dowel passing hole 21. After the whole piece of log is cut into a cylinder, the log is taken out, and two ends are removed to obtain the dowel. According to the tool, the dowel may be machined more conveniently. The tool may match various rotatable components to machine the dowel, such that machining is more convenient. In addition, the tool is simple in structure, low in cost and more efficient in machining, and end product quality of the dowel is higher. In order to machine various dowels having different diameters, a plurality of different types of dowel cutting members 2 may be arranged, and cutting member through holes 21 having different diameters are provided on the dowel cutting members 2 respectively, which may be used for machining various dowels and may be selected according to requirements. In the embodiment, the cutters 3 are separated from the dowel positioning portion 2, and are fixed on the base 1 by means of the cutter fixing portions 4, and the positions of the cutters 3 may be adjusted by means of the cutter fixing portions 4, so as to meet cutting requirements of various dowels having different diameters. Therefore, use is more convenient, and an application range is wider.

Figure 2:
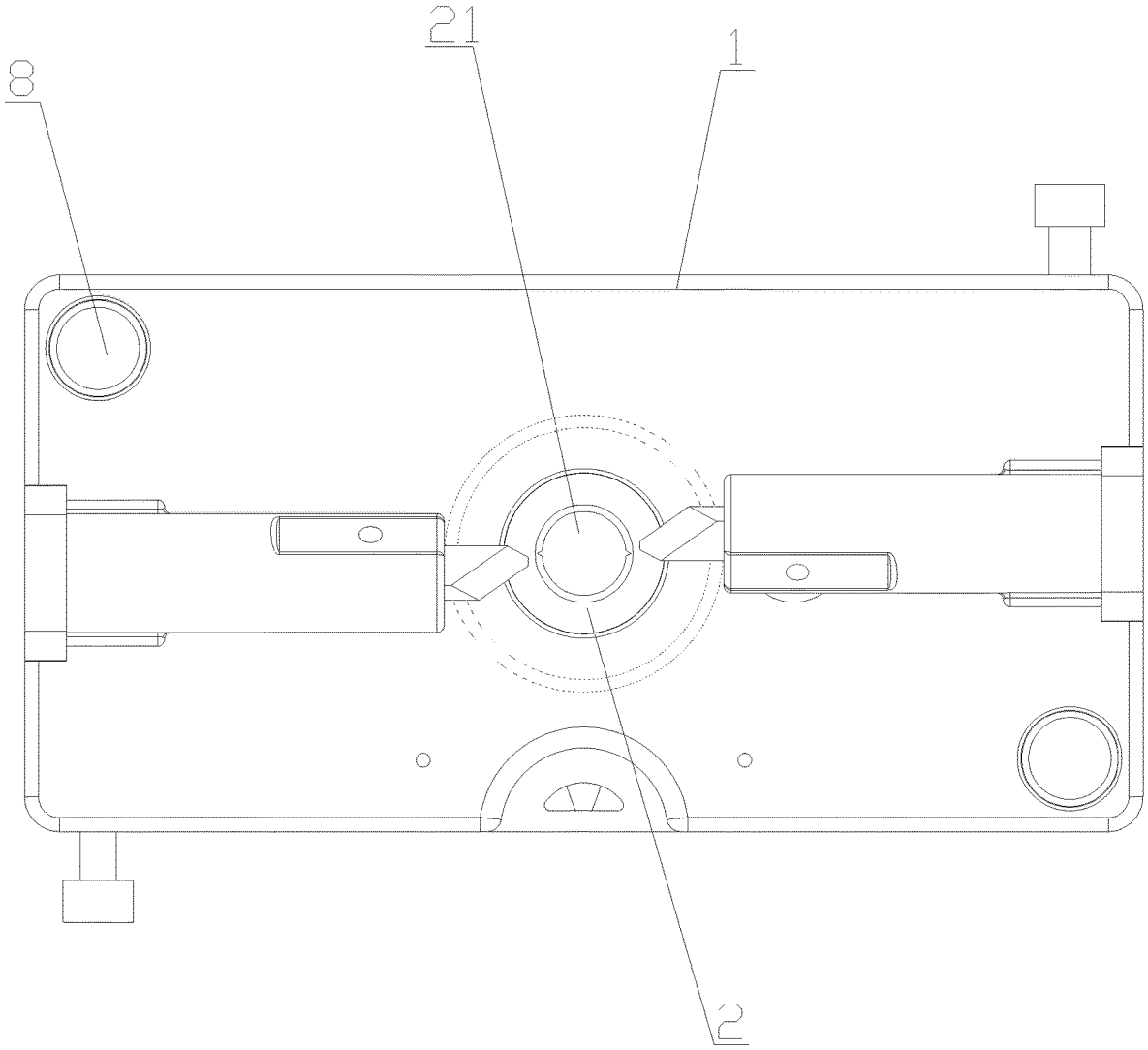
FIG. 2 is a top view of structures in Embodiments 1, 2, 3 and 4 of a portable dowel making tool of the present disclosure.
Figure 5:
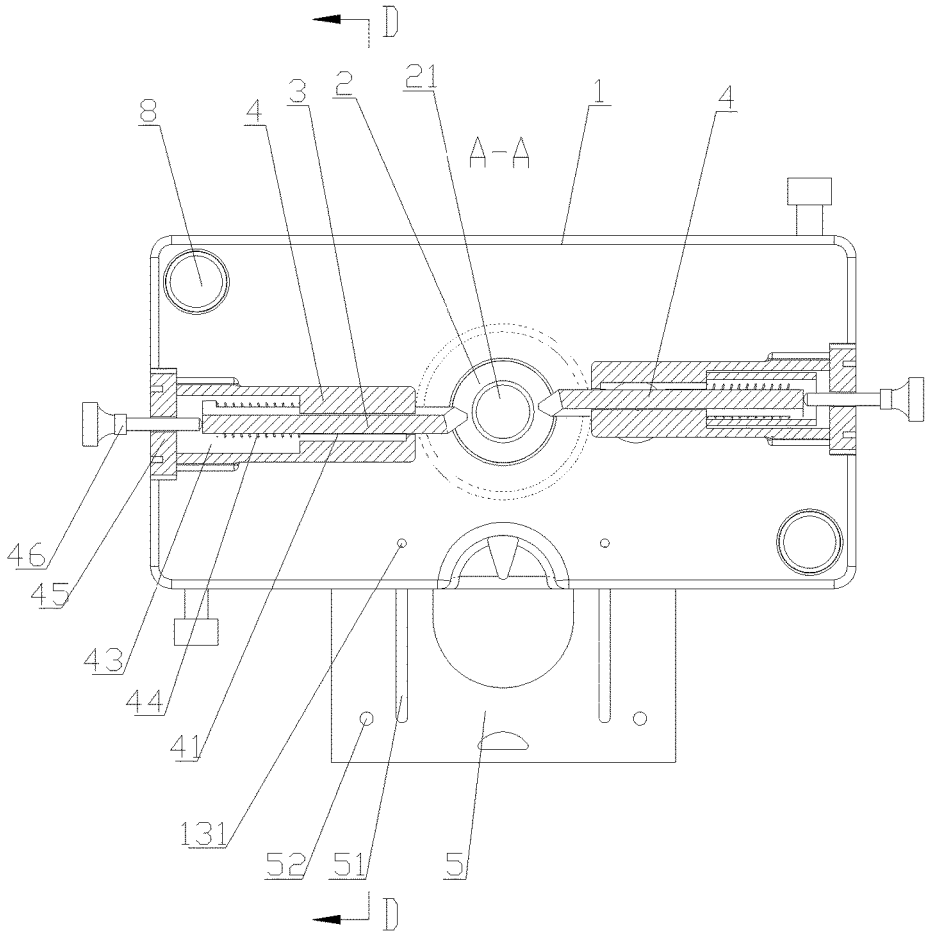
FIG. 5 is a structural schematic diagram of a section of part A-A in FIG. 4.

With reference to FIG. 1, FIG. 2 and FIG. 5, cutter fixing grooves 41 facing a dowel passing hole 21 end are provided in the cutter fixing portions 4, the cutters 3 are movably arranged in the cutter fixing grooves 41, cutting edge ends of the cutters 3 may extend out from ends, close to the dowel passing hole 21, of the cutter fixing grooves 41, and cutter locking members 42 which abut against and match the cutters 3 in the cutter fixing grooves 41 are arranged on the cutter fixing portions 4. The cutters 3 are movably fixed in the cutter fixing grooves 41, so as to be convenient to assemble, disassemble and replace, and the positions of the cutters 3 may be conveniently adjusted according to requirements. The cutter locking members 42 are used to lock the cutters 3 such that the cutters 3 may be fixed more stably. The cutter locking members 42 may be screws in threaded connection to the cutter fixing portions 4.

With reference to FIG. 1, FIG. 2 and FIG. 5, end covers 45 are detachably arranged on ends, away from the dowel passing hole 21, of the cutter fixing portions 4. Adjusting bolts 46 which may drive the cutters 3 to move towards the ends close to the dowel passing hole 21 are arranged on the end covers 45. Adjusting bolts 46 for driving the cutters 3 to move towards the ends close to the dowel passing hole 21 are arranged on the cutter fixing portions 4, elastic member cavities 43 in communication with the cutter fixing grooves 41 are provided in the cutter fixing portions 4, and first elastic members 44 for driving the cutters 3 to move along the cutter fixing grooves 41 towards ends away from the dowel passing hole 21 are arranged in the spring cavities 43. In the embodiment, the elastic members 44 and the adjusting bolts 46 are arranged in the cutter fixing portions 4 such that the positions of the cutter 3 may be conveniently adjusted. The adjusting bolts 46 are screwed towards a dowel positioning portion 2 end, so as to drive the cutters 3 to slide towards the dowel positioning portion 2. When the adjusting bolts 46 are reversely screwed, the elastic members 44 may drive the cutters 3 to automatically slide towards an end away from the dowel positioning portion 2 to return such that the cutters 3 may be adjusted more conveniently and may move forward and backward freely.

Preferentially, in the embodiment, the elastic members 44 are springs, the springs directly sleeve the cutters 3, and cutter stop blocks capable of matching the springs are arranged at ends, away from cutting edges, of the cutters 3.

According to the mechanism, the cutters 3 and the elastic members 44 may be assembled and disassembled more conveniently, and the elastic members 44 may be reused.

Figure 6:
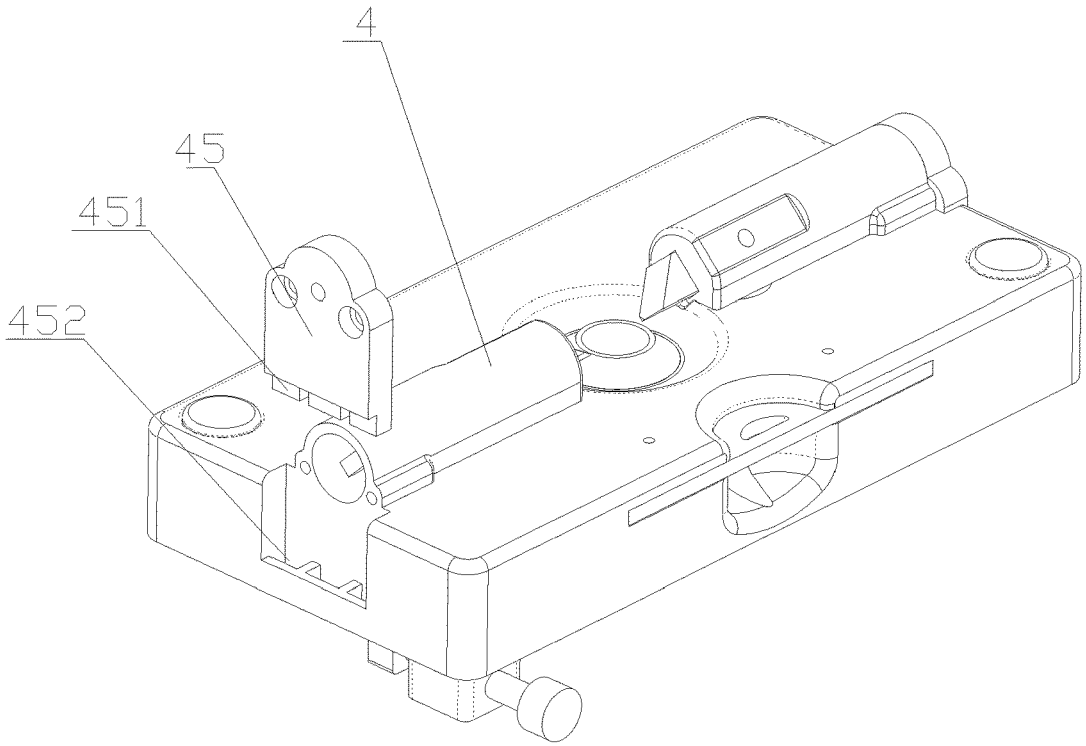
FIG. 6 is a structural schematic diagram of an end cover and a cutter fixing portion of a portable dowel making tool of the present disclosure.

With reference to FIG. 6, the end covers 45 matching the cutter fixing grooves 41 are detachably arranged at the ends, away from the dowel passing hole 21, of the cutter fixing portions 4, end cover fixing inserted pins 451 and end cover fixing insertion holes 452 which mutually match in an insertion manner are arranged on the end covers 45 and the cutter fixing portions 4 respectively, and arrangement directions of the end cover fixing inserted pins 451 are perpendicular to or nearly perpendicular to elastic force directions of the elastic members 44. Fixing screws are further arranged between the end covers 45 and the cutter fixing portions 4. The end cover fixing inserted pins 451 in the directions perpendicular to the elastic force directions of the elastic members 44 are arranged to match the end cover fixing insertion holes 452 such that the end covers 45 may match the cutter fixing portions 4 in an insertion manner, thereby improving connection stability. After the fixing screws between the end covers 45 and the cutter fixing portions 4 are loosened, the end covers 45 may not be bounced off by the elastic members 44 under actions of the end cover fixing inserted pins 451, thereby improving safety during disassembly and assembly, and disassembly and assembly are more convenient.

With reference to FIG. 1, the cutting edges of the cutters 3 are inclined relative to an axis of the dowel passing hole 21. The inclined cutting edges of the cutter 3 may conveniently cut in log, such that cutting is smoother, burrs are less, and loss of the cutters 3 is smaller.

Figure 7:
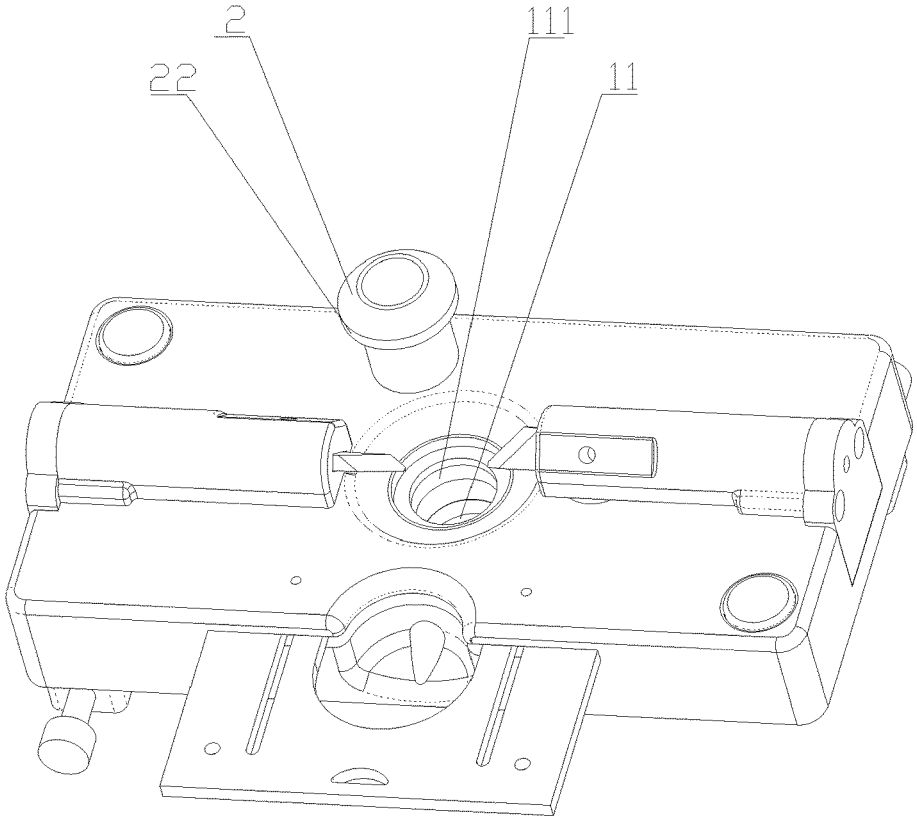
FIG. 7 is a schematic diagram of a three-dimensional structure in the case that a fixing plate of a portable dowel making tool of the present disclosure is pulled out.

With reference to FIG. 7, a positioning portion fixing hole 11 for carrying the dowel positioning portion 2 is provided on the base 1, the dowel positioning portion 2 is detachably arranged in the positioning portion fixing hole 11, a dowel positioning portion limiting flange 22 is arranged at one end, close to the cutters 3, of the dowel positioning portion 2, and a limiting groove matching the dowel positioning portion limiting flange 22 is arranged at one end, close to the cutters 3, of the positioning portion fixing hole 11. The dowel positioning portion 2 may be separated from the base 1 such that the dowel positioning portion 2 may be conveniently replaced, and dowel positioning portions 2 having different diameters may be replaced according to machining requirements. The dowel positioning portion limiting flange 22 is arranged to match the limiting groove, such that mounting accuracy of the dowel positioning portion 2 is improved, and fixing firmness of the dowel positioning portion 2 is improved. The dowel positioning portion limiting flange 22 is arranged at one side close to the cutters 3, such that the dowel positioning portion 2 is prevented from being ejected out of the positioning portion fixing hole 11 by the dowel in a cutting process.

Figure 4:
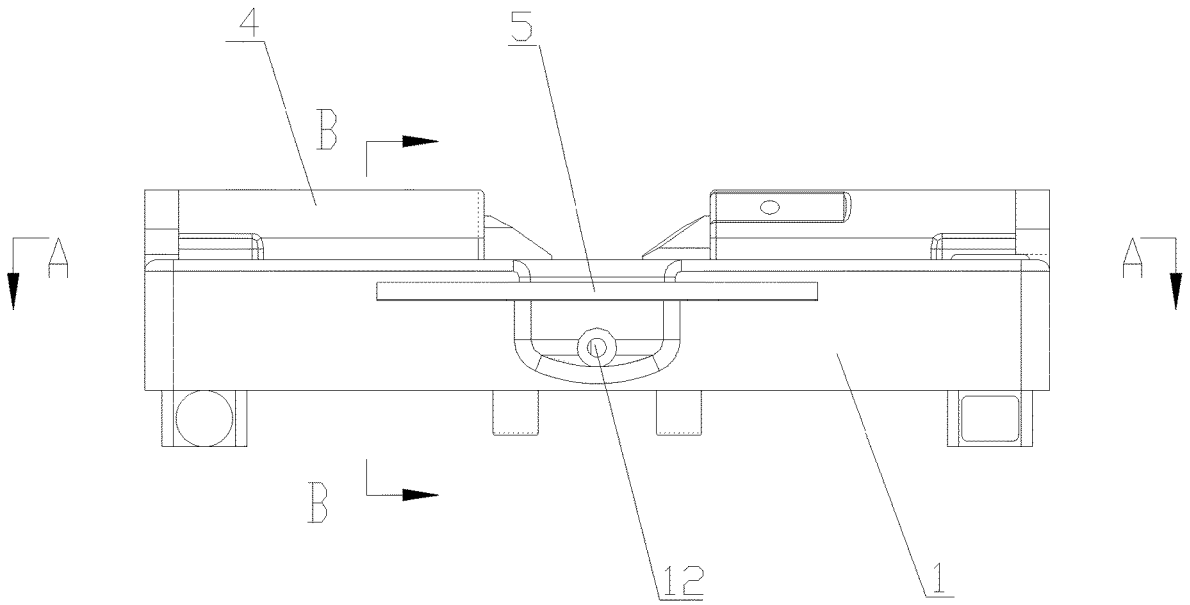
FIG. 4 is a front view of structures in Embodiments 1, 2, 3 and 4 of a portable dowel making tool of the present disclosure.

With reference to FIG. 4, a locking mechanism for fixing the dowel positioning portion 2 in the positioning portion fixing hole 11 is arranged on the base 1. The locking mechanism includes a positioning portion locking hole 12 in communication with the positioning portion fixing hole 11, and a bolt which abuts against and matches the side edge of the dowel positioning portion 2 may be arranged in the positioning portion locking hole 12. By arranging the bolt in the positioning portion locking hole 12, the dowel positioning portion 2 may be fixed in the positioning portion fixing hole 11, so as to prevent the dowel positioning portion 2 from falling off After the dowel positioning portion 2 is locked by means of the bolt, the dowel positioning portion 2 may not rotate such that a worker may conveniently determine whether to lock the dowel positioning portion 2 or not according to actual requirements.

With reference to FIG. 7, several rotary bearings 111 matching the dowel positioning portion 2 are arranged in the positioning portion fixing hole 11. By arranging the rotary bearings 111, the dowel positioning portion 2 may rotate in the positioning portion fixing hole 11, so as to conveniently match the dowel rotating, thereby reducing resistance in a rotatable cutting process of the dowel, and further prevent the dowel positioning portion 2 from scratching a surface of the dowel. The locking mechanism may determine whether to lock the dowel positioning portion 2 or not according to machining requirements.

Embodiment 2

Figure 8:
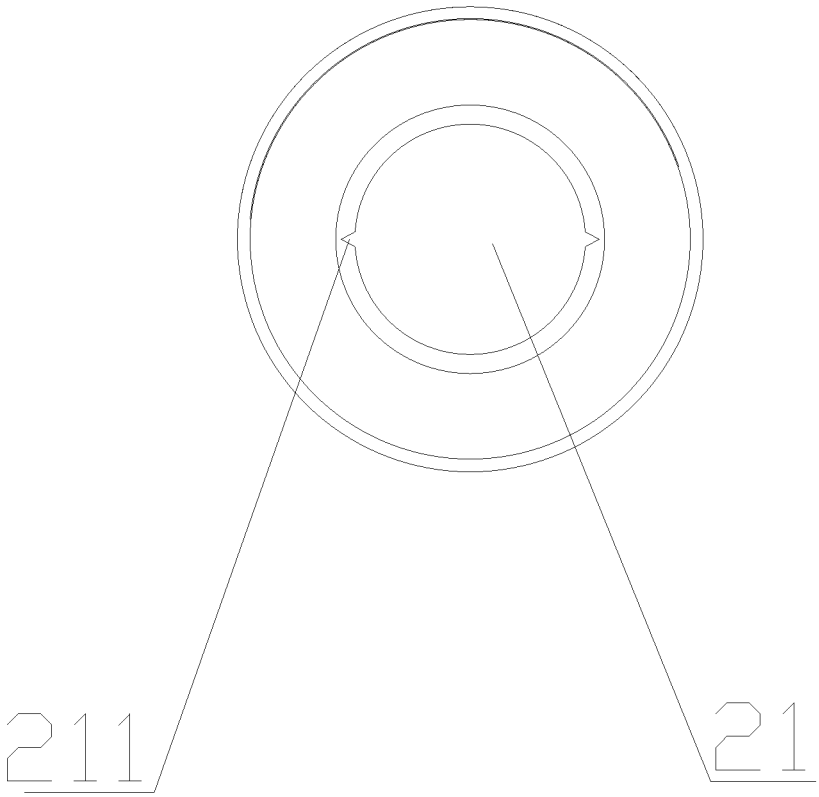
FIG. 8 is a top view of a structure of a dowel positioning portion in Embodiment 2 of a portable dowel making tool of the present disclosure.

With reference to FIG. 8, on the basis of Embodiment 1, positioning grooves 211 are provided on two opposite sides of the dowel passing hole 21 respectively, and a connecting line between the positioning grooves 211 on the two sides intersects the axis of the dowel passing hole 21. By providing the positioning grooves 211 on inner walls of the two sides of the dowel passing hole 21, punching positioning may be realized. A straight line is drawn on a surface of a workpiece to be punched, the tool is arranged in the straight line on the surface of the workpiece, the two positioning grooves 211 are aligned with the straight line such that a center of the dowel passing hole 21 may be positioned in the straight line, and a punching drill bit penetrates the dowel passing hole 21 for punching. Therefore, punching positioning is convenient, punching is more convenient, and punching accuracy is improved, thereby realizing dual purposes of making and punching positioning of the dowel by the tool.

Embodiment 3

Figure 9:
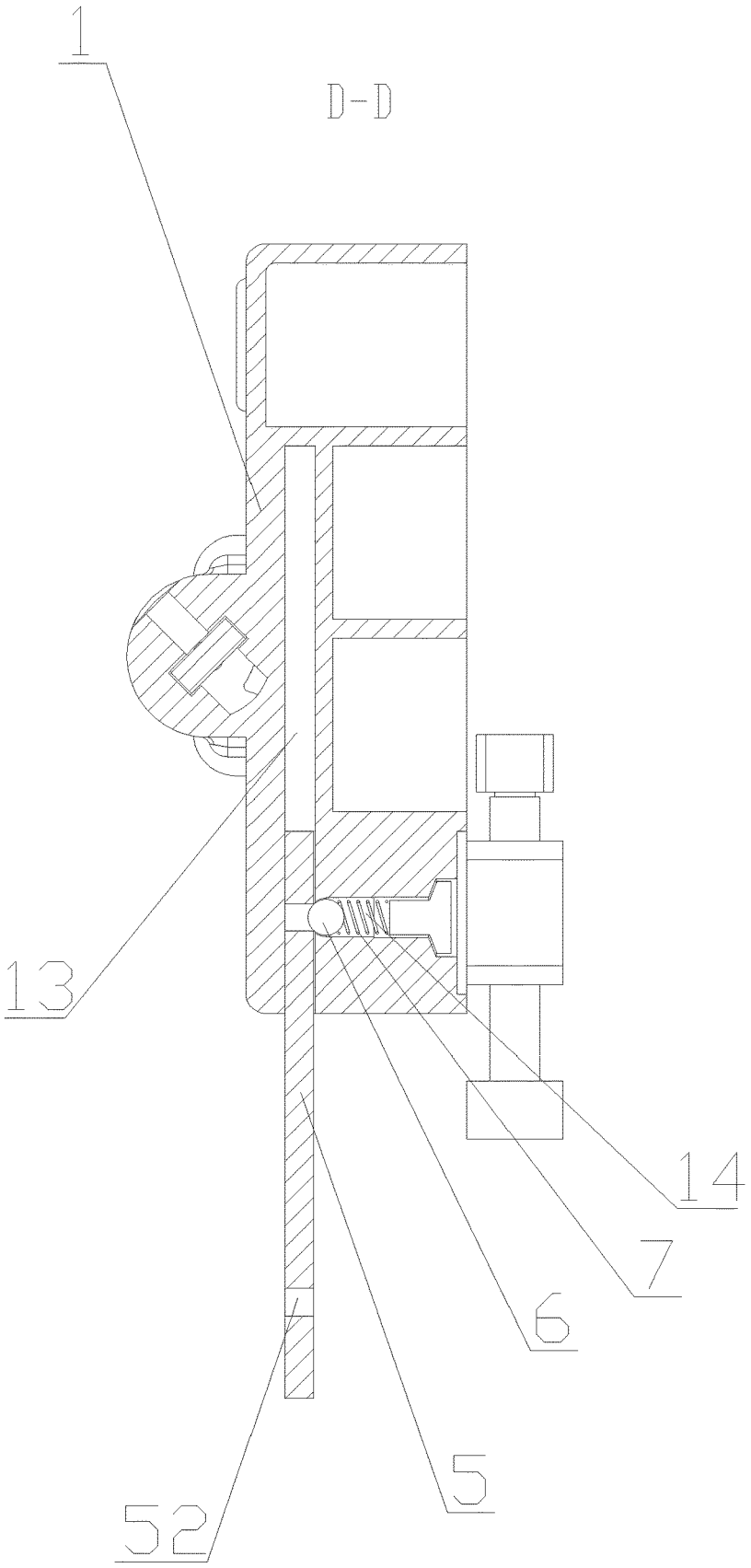
FIG. 9 is a structural schematic diagram of a section of part D-D in FIG. 5.

With reference to FIG. 5, FIG. 7 and FIG. 9, the tool further includes a fixing plate 5 arranged on the base 1, a fixing plate accommodating groove 13 matching the fixing plate 5 on the base 1 is provided on the base 1, and the fixing plate 5 is slidably arranged in the fixing plate accommodating groove 13. The fixing plate 5 may match clamping equipment such as a bench vice to fix the tool such that the tool may be fixed more conveniently. The fixing plate accommodating groove 13 may be used for accommodating the fixing plate 5, and when not in use, the fixing plate 5 may be directly retracted into the fixing plate accommodating groove 13, so as to prevent the fixing plate 5 from affecting operation.

With reference to FIG. 5, FIG. 7 and FIG. 9, several fixing plate limiting chutes 51 are provided on the fixing plate 5, several limiting pins 131 matching the fixing plate limiting chutes 51 are arranged in the fixing plate accommodating groove 13, and the limiting pins 131 are slidably connected to the fixing plate limiting chutes 51. The limiting pins 131 are slidably connected to the fixing plate limiting chutes 51. The limiting pins 131 match the limiting chutes 51 to limit a position of the fixing plate 5, so as to prevent the fixing plate 5 from being separated from the fixing plate accommodating groove 13.

With reference to FIG. 5, FIG. 7 and FIG. 9, a positioning mechanism which matches the fixing plate 5 so as to position and fix the fixing plate 5 is arranged on the base 1. The positioning mechanism includes a positioning top ball 6 and a positioning ball elastic driving member 7, a positioning mechanism mounting cavity 14 in communication with the fixing plate accommodating groove 13 is provided on the base 1, the positioning top ball 6 and the positioning ball elastic driving member 7 for driving the positioning top ball 6 to move towards a fixing plate accommodating groove 13 end are movably arranged in the positioning mechanism mounting cavity 14, and several positioning holes 52 matching the positioning top ball 6 are provided on the fixing plate 5. Each positioning hole 52 should have a diameter smaller than that of the positioning top ball 6. When the fixing plate 5 is pulled, the positioning top ball 6 may roll along a surface of the fixing plate 5. When the positioning top ball rolls to the positioning hole 52, the positioning ball elastic driving member 7 drives the positioning top ball 6 to fall into the positioning hole 52, so as to lock and fix a relative position between the base 1 and the fixing plate 5, thereby preventing the fixing plate 5 from moving. When the fixing plate 5 needs to be retracted, only by pushing the fixing plate 5, the positioning top ball 6 may be extruded out of the positioning hole 52. Therefore, automatic locking and unlocking are achieved, use is more convenient, and use of the fixing plate 5 is more stable.

Embodiment 4

Figure 3:
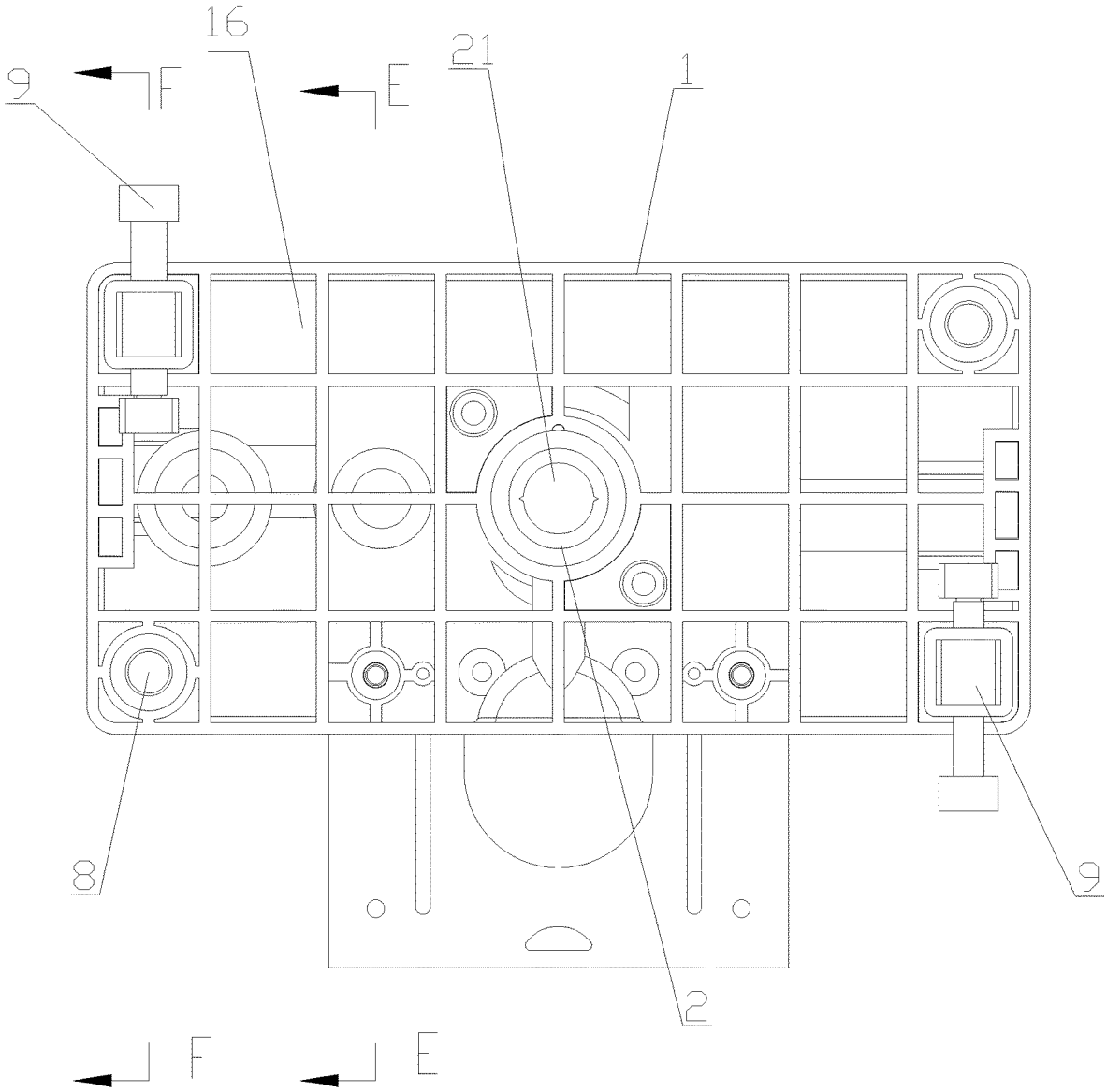
FIG. 3 is a bottom view of structures in Embodiments 1, 2, 3 and 4 of a portable dowel making tool of the present disclosure.
Figure 10:
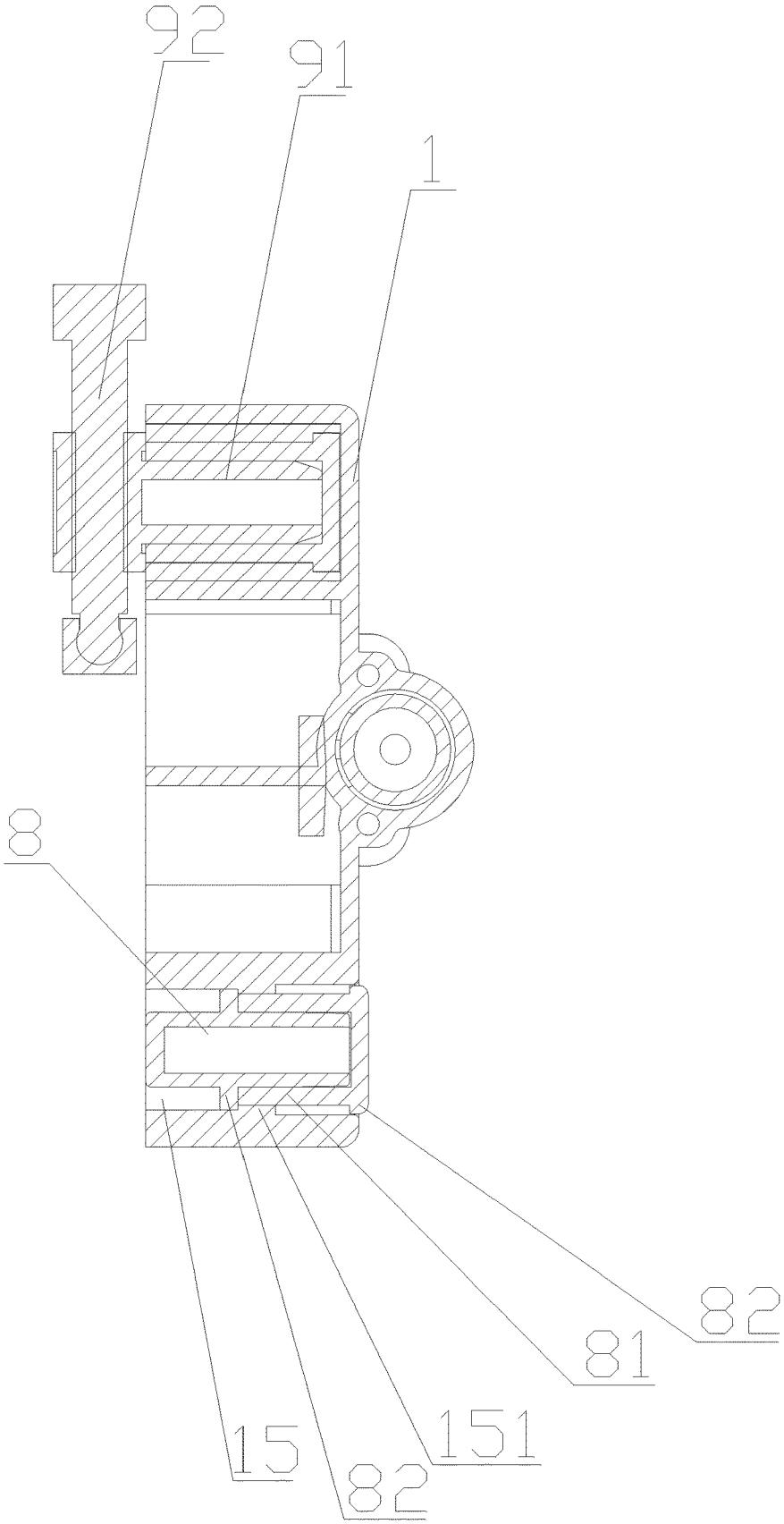
FIG. 10 is a structural schematic diagram of a section of part F-F in FIG. 4.

With reference to FIG. 3 and FIG. 10, punching positioning stop columns 8 are arranged at two opposite corners of the base 1 respectively, the punching positioning stop columns 8 and the dowel passing hole 21 are arranged in the same straight line, and spacing between the punching positioning stop columns 8 on two sides and the dowel passing hole 21 is the same. The two punching positioning stop columns 8 may match the dowel passing hole 21 to position a center line position of a plate. When punching is required at the center line position of the plate, the punching positioning stop columns 8 on the two sides are clamped on two surfaces of the plate respectively, and a position corresponding to the dowel passing hole 21 is the center line position between the two surfaces of the plate. Therefore, positioning is more convenient, punching is more convenient, punching accuracy is higher, and a multi-purpose tool is realized.

With reference to FIG. 3 and FIG. 10, positioning stop column holes 15 for mounting the punching positioning stop columns 8 are provided on the base 1, protruding limiting flanges 151 are arranged in the positioning stop column holes 15, stop column limiting sliding rod sections 81 matching the limiting flanges 151 are arranged on the punching positioning stop columns 8, stop column flanges 82 matching the limiting flanges 151 are arranged on two ends of each positioning stop column 8, and the stop column limiting sliding rod sections 81 are slidably connected to the limiting flanges 151 such that the punching positioning stop columns 8 may be accommodated in the positioning stop column holes 15 or may extend out from ends of the positioning stop column holes 15. The stop column limiting sliding rod sections 81 are slidably connected to the limiting flanges 151 such that the punching positioning stop columns 8 may be accommodated in the positioning stop column holes 15 or extend out from the ends of the positioning stop column holes 15. By arranging the positioning stop columns 8 in the positioning stop column holes 15, and by means of matching between the limiting flanges 151 and the stop column flanges 82, movement ranges of the positioning stop column holes 15 are limited. When not in use, the positioning stop columns 8 may be retracted into the positioning stop column holes 15, such that accommodation is convenient, and the positioning stop columns 8 are prevented from affecting use of the tool.

With reference to FIG. 3 and FIG. 10, several clamping members 9 for fixing the base 1 are arranged on the base 1, the clamping members 9 include clamping member fixing blocks 91 arranged on the base 1 and clamping bolts 92 transversely arranged on the clamping member fixing blocks 91, and the clamping bolts 92 are in threaded connection to the clamping member fixing blocks 91. By means of mutual matching of the clamping bolts 92, the tool may be fixed on a wooden board or a workpiece by means of the base 1 such that the tool may be fixed more conveniently. In the embodiment, the clamping bolts 92 are arranged opposite the punching positioning stop columns 8 such that the clamping bolts 92 may match the punching positioning stop columns 8 to fix the tool on a log board or a workpiece. Therefore, cost and space are saved, and the punching positioning stop columns 8 are fully used.

With reference to FIG. 3 and FIG. 10, several fixing block mounting cavities 16 which are provided at different positions and match the clamping member fixing blocks 91 are provided on the base 1, and the clamping member fixing blocks 91 are detachably arranged in the fixing block mounting cavities 16. The clamping member fixing blocks 91 are detachably arranged in the fixing block mounting cavities 16. By means of a modular design, whether to arrange and adjust the clamping members 9 or not may be determined according to actual situations, positions of the clamping members 9 may be conveniently adjusted, use is more convenient, and configuration is more humanized.

Embodiment 5

Figure 11:
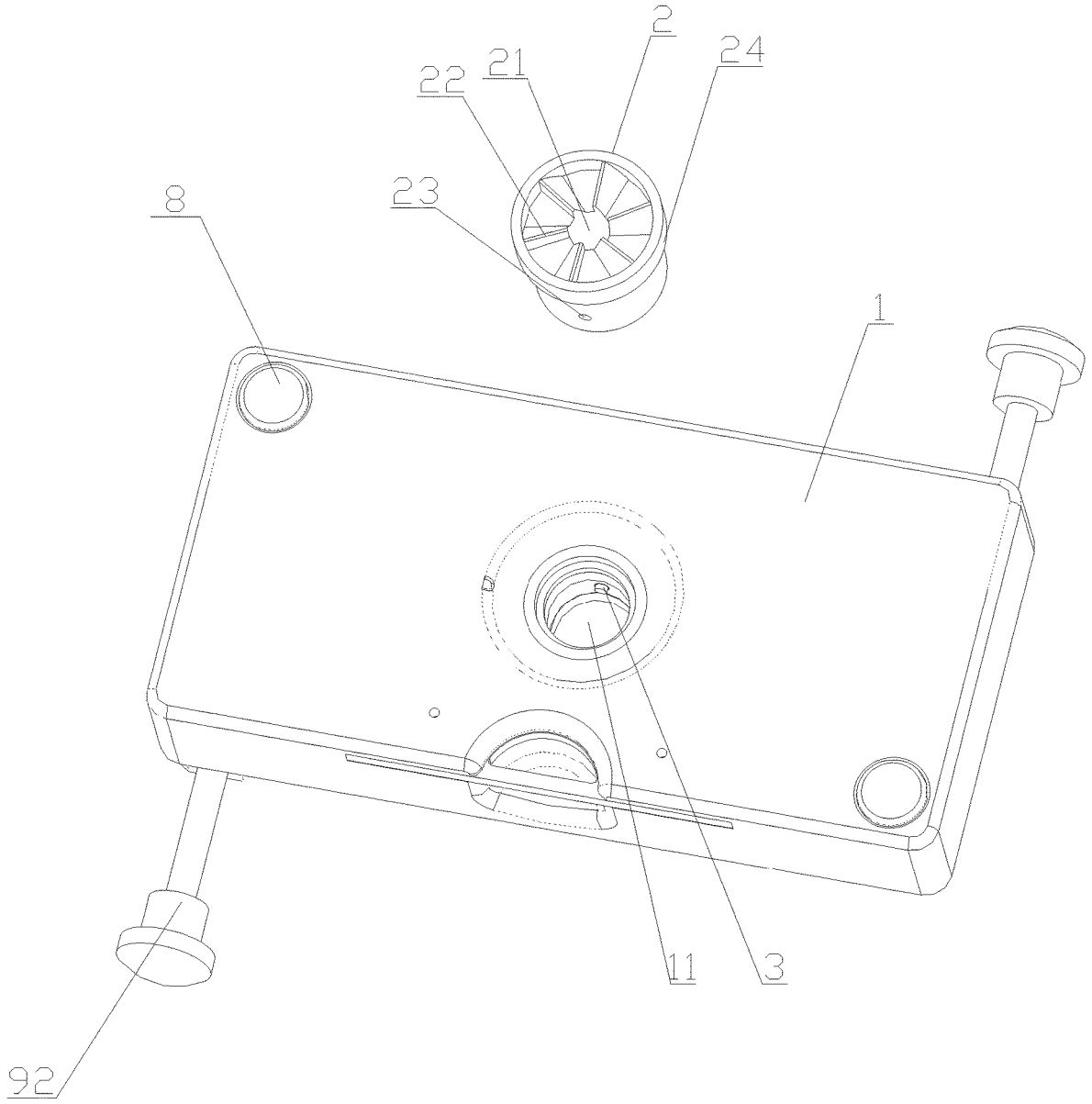
FIG. 11 is a schematic diagram of a three-dimensional structure in Embodiment 5 of a portable dowel making tool of the present disclosure.
Figure 12:
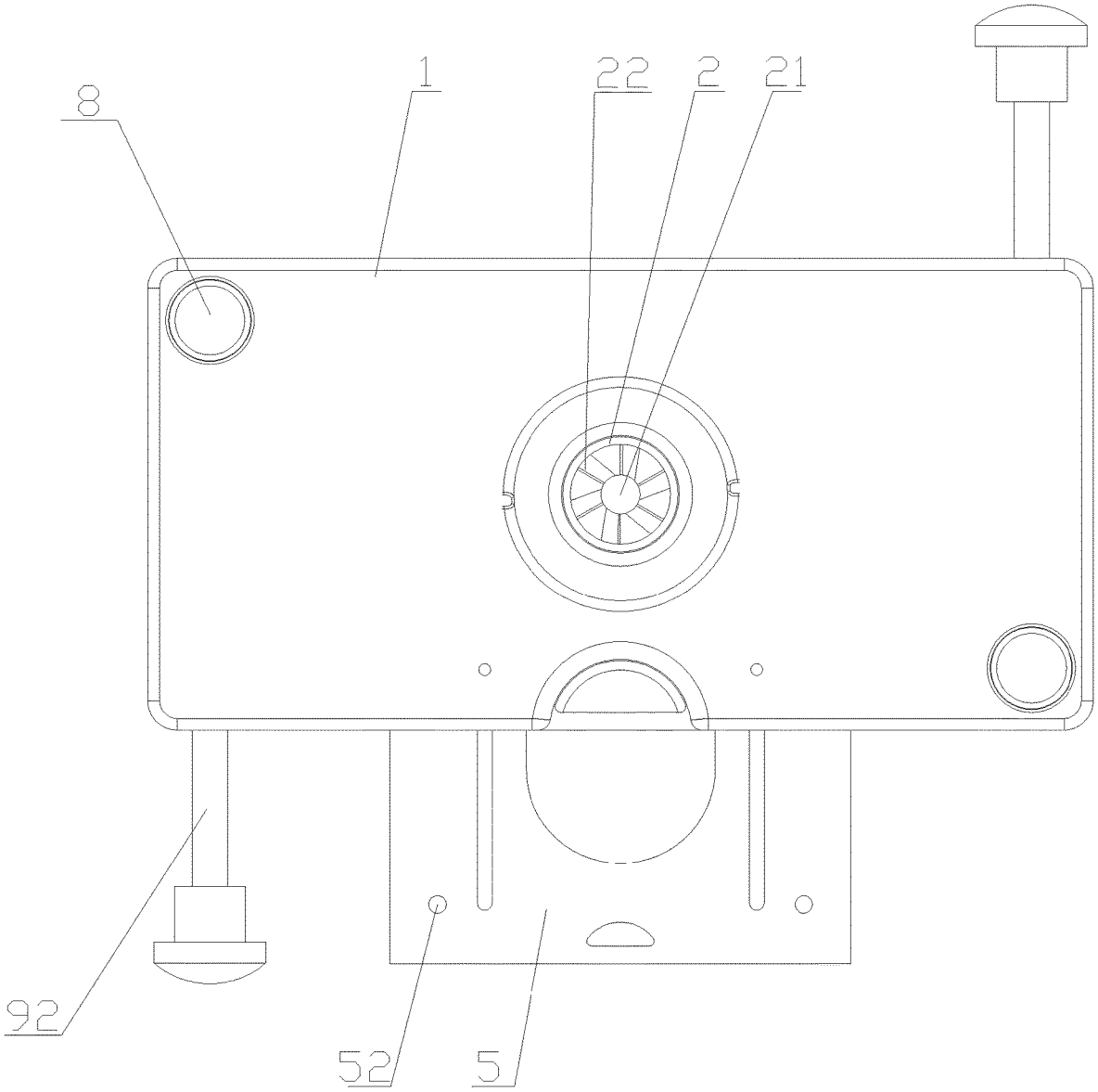
FIG. 12 is a top view of a structure in Embodiment 5 of a portable dowel making tool of the present disclosure.

With reference to FIG. 11 and FIG. 12, a portable dowel making tool of the present disclosure includes a base 1, and a dowel positioning portion 2 is arranged on the base 1. A dowel passing hole 21 for a dowel to pass through is provided on the dowel positioning portion 2, and the dowel positioning portion 2 is provided with a cutting mechanism which matches the dowel passing hole 21 so as to cut, when a material rotates, the material into a cylinder capable of passing through the dowel passing hole 21. The cutting mechanism includes several positioning portion cutters 22 which are arranged on the dowel positioning portion 2 and arranged around the dowel passing hole 21. The differences between the embodiment and Embodiment 1 lie in that in the embodiment, the cutters 22 are directly arranged on the dowel cutting member 2, such that use is more convenient, cutting accuracy is higher, quality of the cutters is better, replacement is more convenient, the cutters do not need to be adjusted, cost is low, and the tool is suitable for machining some dowels having fixed diameters.

Figure 13:
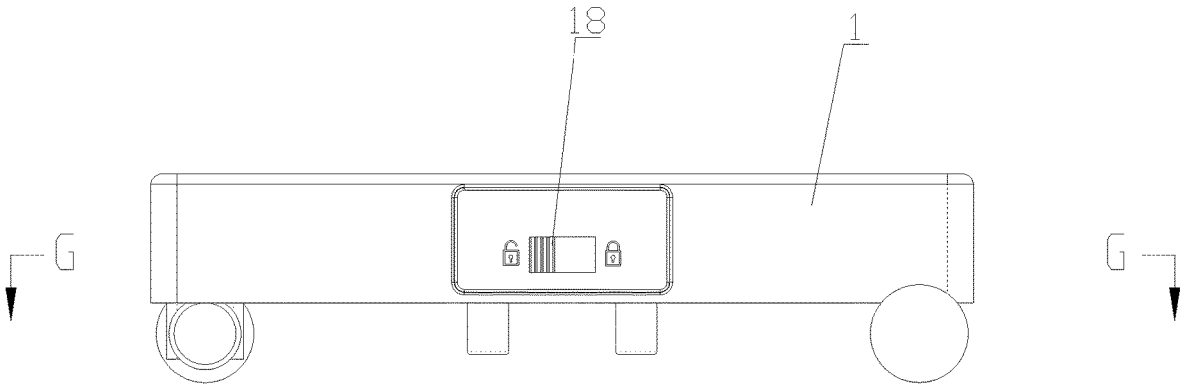
FIG. 13 is a front view of a structure in Embodiment 5 of a portable dowel making tool of the present disclosure.
Figure 14:
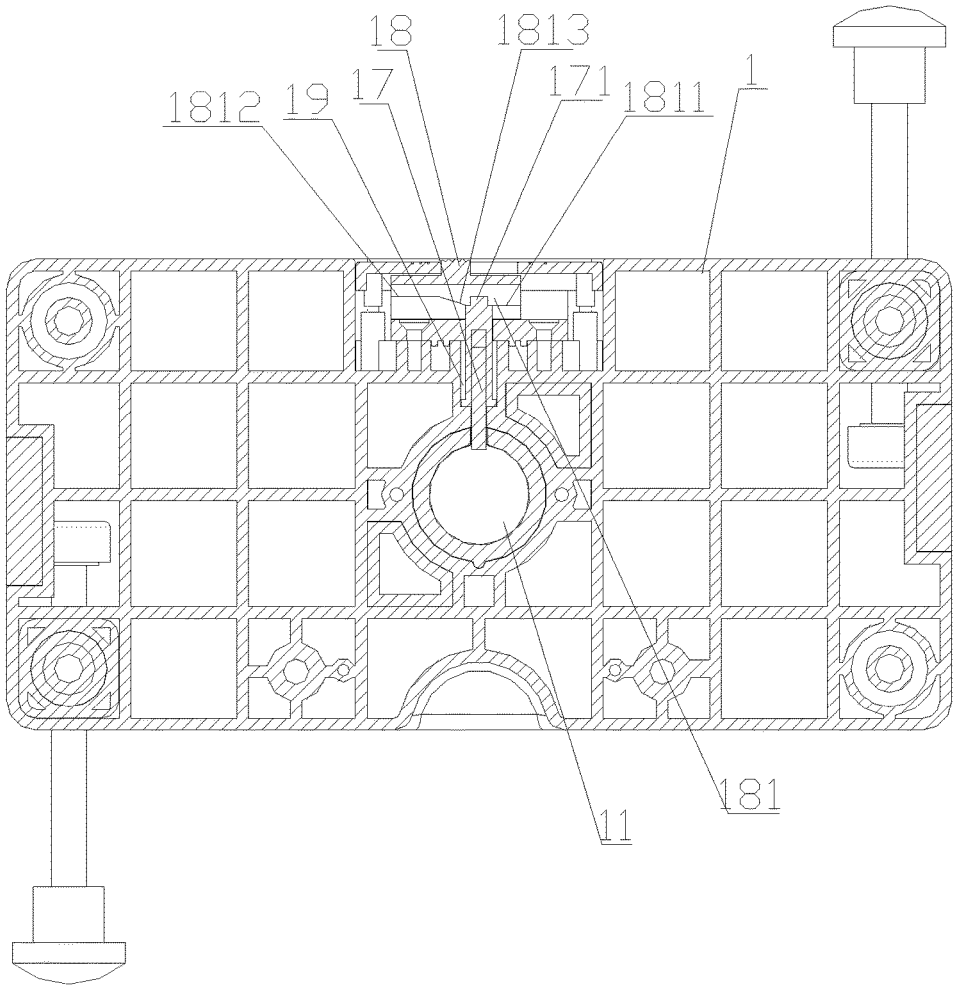
FIG. 14 is a structural schematic diagram of part G-G in FIG. 13.

With reference to FIG. 13 and FIG. 14, on the basis of Embodiment 1, a locking mechanism for fixing the dowel positioning portion 2 in the positioning portion fixing hole 11 is arranged on the base 1. The locking mechanism includes a lock pin 17 and a switch 18 in control connection to the lock pin 17, a pin hole 19 adapted to the lock pin 17 is transversely provided in the base 1, the pin hole 19 is in communication with the positioning portion fixing hole 11, the lock pin 17 is slidably arranged in the pin hole 19, the switch 18 is arranged at a position, close to the pin hole 19, of the base 1 and is used for controlling the lock pin 17 to slide towards an end away from or close to a dowel cutting member 2 end, and an insertion hole 23 adapted to the lock pin 17 is provided on a side wall of the dowel cutting member 2. By arranging the locking mechanism to match the dowel positioning portion 2, the dowel positioning portion 2 may be locked in the positioning portion fixing hole 11, so as to prevent the dowel positioning portion 2 from falling off, thereby improving safety. Moreover, the dowel positioning portion 2 may be conveniently replaced, and when the dowel positioning portion needs to be replaced, the switch 18 is used to directly control the lock pin 17 to retract into the pin hole 19.

With reference to FIG. 13 and FIG. 14, the switch 18 is slidably arranged on the base 1, a control chute 181 adapted to the lock pin 17 is provided on one side, close to the lock pin 17, of the switch 18, and a protruding block 171 slidably matching the control chute 181 is arranged on one end, close to the switch 18, of the lock pin 17. The control chute 181 includes a locking section 1811 and a loosening section 1812, and the locking section 1811 and the loosening section 1812 are connected by means of a slope section 1813. Under the situation that the protruding block 171 matches the locking section 1811, one end of the lock pin 17 extends into the positioning portion fixing hole 11. Under the situation that the protruding block 171 matches the loosening section 1812, the lock pin 17 is retracted into the pin hole 19. By means of sliding the control switch 18, the locking section 1811 or the loosening section 1812 matches the protruding block 171, so as to control the lock pin 3 to be locked and loosened, and therefore, control is more convenient.

Embodiment 6

Figure 15:
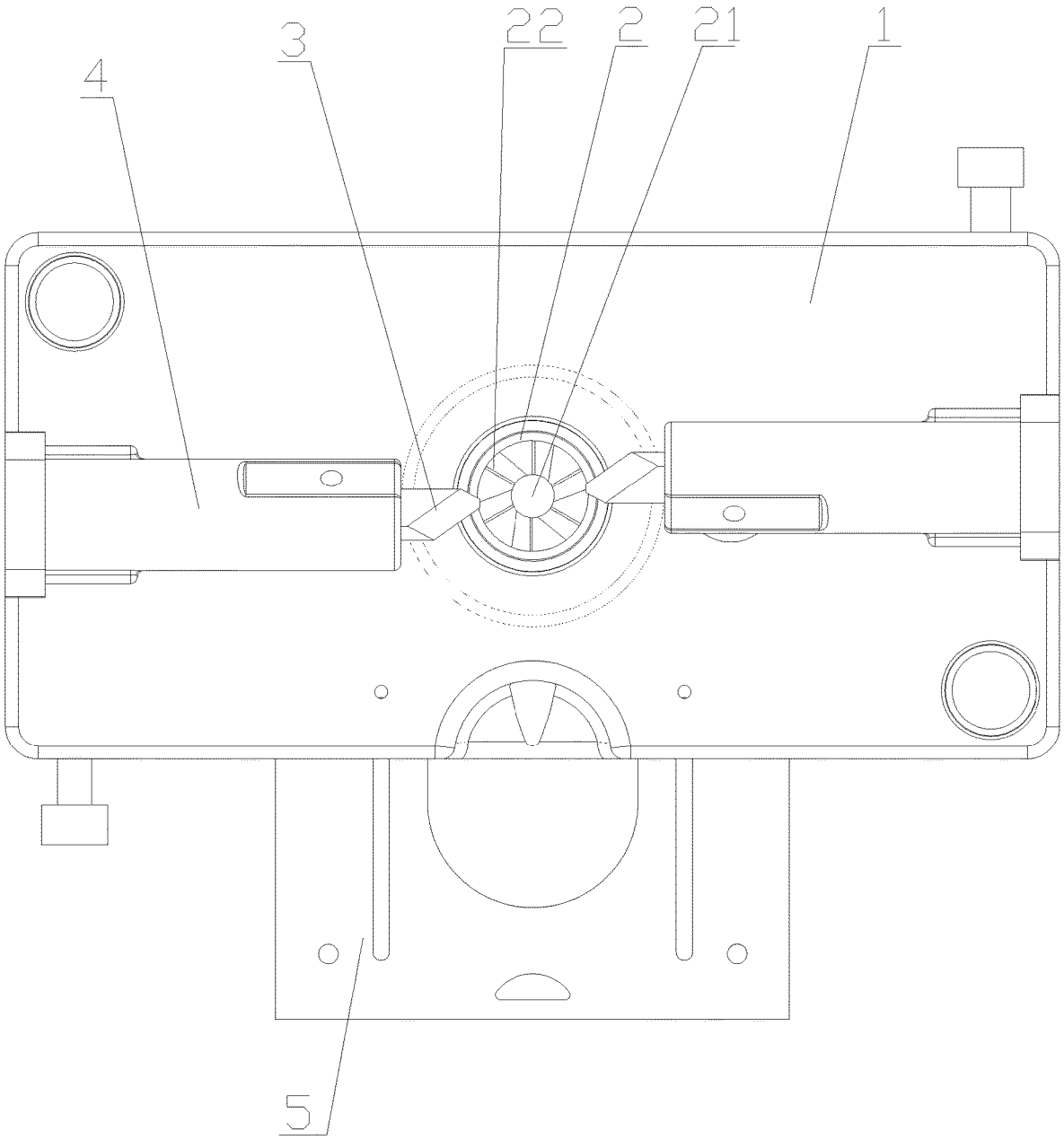
FIG. 15 is a top view of a structure in Embodiment 6 of a portable dowel making tool of the present disclosure.

With reference to FIG. 15, a portable dowel making tool of the present disclosure includes a base 1, and a dowel positioning portion 2 is arranged on the base 1. A dowel passing hole 21 for a dowel to pass through is provided on the dowel positioning portion 2, and the base 1 and the dowel positioning portion 2 are provided with a cutting mechanism which matches the dowel passing hole 21 so as to cut, when a material rotates, the material into a cylinder capable of passing through the dowel passing hole 21. The cutting mechanism includes several positioning portion cutters 22 which are arranged on the dowel positioning portion 2 and arranged around the dowel passing hole 21, cutters 3 which are arranged on the base 1 and face a periphery of the dowel passing hole 21, and cutter fixing portions 4 for fixing and adjusting positions of the cutters 3. In the embodiment, the cutting mechanism in Embodiment 1 and the cutting mechanism in Embodiment 5 are combined, the dowel positioning portion 2 with the positioning portion cutters 22 are combined with the cutters 3 arranged on the base 1, and the two types of cutters mutually match for cutting, such that cutting efficiency and quality are obviously improved, and a surface of the cut dowel is smoother.

A working process of the present disclosure is as follows:

In a working process of the portable dowel making tool of the present disclosure, when in use, the log to be cut is fixed on a rotatable driving member, such as an electric drill, an end of the log is aligned with the dowel passing hole 21, and in order to make the end of the log conveniently inserted into the dowel passing hole 21, a tip or a thin rod capable of being conveniently inserted into the dowel passing hole 21 may be machined at the end of the log in advance. The rotatable driving member is started to drive the log to rotate, so as to make a side edge of the log in contact with the cutters 3 or the positioning portion cutters 22, then a redundant portion of the log is cut off, and the cut log is in a shape of a cylinder capable of passing through the dowel passing hole 21. After the whole piece of log is cut into a cylinder, the log is taken out, and two ends are removed to obtain the dowel.

The above embodiments are illustrations of the present disclosure, and are not limitations of the present disclosure, and any solution after simple transformation of the present disclosure fall within the scope of protection of the present disclosure.

What is claimed is:

1. A portable dowel making tool, comprising a base (1), wherein a dowel positioning portion (2) is arranged on the base (1), the dowel positioning portion (2) is provided with a dowel passing hole (21) for a dowel to pass through, the base (1) or/and the dowel positioning portion (2) is/are provided with a cutting mechanism which matches the dowel passing hole (21) so as to cut, when a material rotates, the material into a cylinder capable of passing through the dowel passing hole (21), and the cutting mechanism comprises several positioning portion cutters (22) which are arranged on the dowel positioning portion (2) and arranged around the dowel passing hole (21); or/and cutters (3) which are arranged on the base (1) and face a periphery of the dowel passing hole (21) and cutter fixing portions (4) for fixing and adjusting positions of the cutters (3);

wherein the portable dowel making tool further comprises:

a fixing plate (5) arranged on the base (1), wherein a fixing plate accommodating groove (13) matching the fixing plate (5) on the base (1) is provided on the base (1), and the fixing plate (5) is slidably arranged in the fixing plate accommodating groove (13).

2. The portable dowel making tool according to claim 1, wherein cutter fixing grooves (41) facing a dowel passing hole (21) end are provided in the cutter fixing portions (4), the cutters (3) are movably arranged in the cutter fixing grooves (41), cutting edge ends of the cutters (3) can extend out from ends, close to the dowel passing hole (21), of the cutter fixing grooves (41), and cutter locking members (42) which abut against and match the cutters (3) in the cutter fixing grooves (41) are arranged on the cutter fixing portions (4).

3. The portable dowel making tool according to claim 2, wherein adjusting bolts (46) for driving the cutters (3) to move towards the ends close to the dowel passing hole (21) are arranged on the cutter fixing portions (4), elastic member cavities (43) in communication with the cutter fixing grooves (41) are provided in the cutter fixing portions (4), and first elastic members (44) for driving the cutters (3) to move along the cutter fixing grooves (41) towards ends away from the dowel passing hole (21) are arranged in the spring cavities (43).

4. The portable dowel making tool according to claim 3, wherein end covers (45) matching the cutter fixing grooves (41) are detachably arranged at the ends, away from the dowel passing hole (21), of the cutter fixing portions (4), end cover fixing inserted pins (451) and end cover fixing insertion holes (452) which mutually match in an insertion manner are arranged on the end covers (45) and the cutter fixing portions (4) respectively, and arrangement directions of the end cover fixing inserted pins (451) are perpendicular to or nearly perpendicular to elastic force directions of the elastic members (44).

5. The portable dowel making tool according to claim 2, wherein cutting edges of the cutters (3) are inclined relative to an axis of the dowel passing hole (21).

6. The portable dowel making tool according to claim 1, wherein a positioning portion fixing hole (11) for carrying the dowel positioning portion (2) is provided on the base (1), the dowel positioning portion (2) is detachably arranged in the positioning portion fixing hole (11), a dowel positioning portion limiting flange (22) is arranged at one end, close to the cutters (3), of the dowel positioning portion (2), and a limiting groove matching the dowel positioning portion limiting flange (22) is arranged at one end, close to the cutters (3), of the positioning portion fixing hole (11).

7. The portable dowel making tool according to claim 6, wherein a locking mechanism for fixing the dowel positioning portion (2) in the positioning portion fixing hole (11) is arranged on the base (1), the locking mechanism comprises a positioning portion locking hole (12) in communication with the positioning portion fixing hole (11), and a bolt which abuts against and matches a side edge of the dowel positioning portion (2) can be arranged in the positioning portion locking hole (12); or the locking mechanism comprises a lock pin (17) and a switch (18) in control connection to the lock pin (17), a pin hole (19) adapted to the lock pin (17) is transversely provided in the base (1), the pin hole (19) is in communication with the positioning portion fixing hole (11), the lock pin (17) is slidably arranged in the pin hole (19), the switch (18) is arranged at a position, close to the pin hole (19), of the base (1) and is used for controlling the lock pin (17) to slide towards an end away from or close to a dowel cutting member (2) end, and an insertion hole (23) adapted to the lock pin (17) is provided on a side wall of the dowel cutting member (2).

8. The portable dowel making tool according to claim 7, wherein the switch (18) is slidably arranged on the base (1), a control chute (181) adapted to the lock pin (17) is provided on one side, close to the lock pin (17), of the switch (18), a protruding block (171) slidably matching the control chute (181) is arranged on one end, close to the switch (18), of the lock pin (17), the control chute (181) comprises a locking section (1811) and a loosening section (1812), the locking section (1811) and the loosening section (1812) are connected by means of a slope section (1813), under the situation that the protruding block (171) matches the locking section (1811), one end of the lock pin (17) extends into the positioning portion fixing hole (11), and under the situation that the protruding block (171) matches the loosening section (1812), the lock pin (17) is retracted into the pin hole (19).

9. The portable dowel making tool according to claim 6, wherein several rotary bearings (111) matching the dowel positioning portion (2) are arranged in the positioning portion fixing hole (11).

10. The portable dowel making tool according to claim 1, wherein positioning grooves (211) are provided on two opposite sides of the dowel passing hole (21) respectively, and a connecting line between the positioning grooves (211) on the two sides intersects an axis of the dowel passing hole (21).

11. The portable dowel making tool according to claim 1, wherein several fixing plate limiting chutes (51) are provided on the fixing plate (5), several limiting pins (131) matching the fixing plate limiting chutes (51) are arranged in the fixing plate accommodating groove (13), and the limiting pins (131) are slidably connected to the fixing plate limiting chutes (51).

12. The portable dowel making tool according to claim 1, wherein a positioning mechanism which matches the fixing plate (5) so as to position and fix the fixing plate (5) is arranged on the base (1), the positioning mechanism comprises a positioning top ball (6) and a positioning ball elastic driving member (7), a positioning mechanism mounting cavity (14) in communication with the fixing plate accommodating groove (13) is provided on the base (1), the positioning top ball (6) and the positioning ball elastic driving member (7) for driving the positioning top ball (6) to move towards a fixing plate accommodating groove (13) end are movably arranged in the positioning mechanism mounting cavity (14), and several positioning holes (52) matching the positioning top ball (6) are provided on the fixing plate (5).

13. The portable dowel making tool according to claim 1, wherein punching positioning stop columns (8) are arranged at two opposite corners of the base (1) respectively, the punching positioning stop columns (8) and the dowel passing hole (21) are arranged in the same straight line, and spacing between the punching positioning stop columns (8) on two sides and the dowel passing hole (21) is the same.

14. The portable dowel making tool according to claim 13, wherein positioning stop column holes (15) for mounting the punching positioning stop columns (8) are provided on the base (1), protruding limiting flanges (151) are arranged in the positioning stop column holes (15), stop column limiting sliding rod sections (81) matching the limiting flanges (151) are arranged on the punching positioning stop columns (8), stop column flanges (82) matching the limiting flanges (151) are arranged on two ends of each positioning stop column (8), and the stop column limiting sliding rod sections (81) are slidably connected to the limiting flanges (151) such that the punching positioning stop columns (8) can be accommodated in the positioning stop column holes (15) or can extend out from ends of the positioning stop column holes (15).

15. The portable dowel making tool according to claim 1, wherein several clamping members (9) for fixing the base (1) are arranged on the base (1), the clamping members (9) comprise clamping member fixing blocks (91) arranged on the base (1) and clamping bolts (92) transversely arranged on the clamping member fixing blocks (91), and the clamping bolts (92) are in threaded connection to the clamping member fixing blocks (91).

16. The portable dowel making tool according to claim 15, wherein several fixing block mounting cavities (16) which are provided at different positions and match the clamping member fixing blocks (91) are provided on the base (1), and the clamping member fixing blocks (91) are detachably arranged in the fixing block mounting cavities (16).

17. A portable dowel making tool, comprising a base (1), wherein a dowel positioning portion (2) is arranged on the base (1), the dowel positioning portion (2) is provided with a dowel passing hole (21) for a dowel to pass through, the base (1) or/and the dowel positioning portion (2) is/are provided with a cutting mechanism which matches the dowel passing hole (21) so as to cut, when a material rotates, the material into a cylinder capable of passing through the dowel passing hole (21), and the cutting mechanism comprises several positioning portion cutters (22) which are arranged on the dowel positioning portion (2) and arranged around the dowel passing hole (21); or/and cutters (3) which are arranged on the base (1) and face a periphery of the dowel passing hole (21) and cutter fixing portions (4) for fixing and adjusting positions of the cutters (3);

wherein punching positioning stop columns (8) are arranged at two opposite corners of the base (1) respectively, the punching positioning stop columns (8) and the dowel passing hole (21) are arranged in the same straight line, and spacing between the punching positioning stop columns (8) on two sides and the dowel passing hole (21) is the same.

18. A portable dowel making tool, comprising a base (1), wherein a dowel positioning portion (2) is arranged on the base (1), the dowel positioning portion (2) is provided with a dowel passing hole (21) for a dowel to pass through, the base (1) or/and the dowel positioning portion (2) is/are provided with a cutting mechanism which matches the dowel passing hole (21) so as to cut, when a material rotates, the material into a cylinder capable of passing through the dowel passing hole (21), and the cutting mechanism comprises several positioning portion cutters (22) which are arranged on the dowel positioning portion (2) and arranged around the dowel passing hole (21); or/and cutters (3) which are arranged on the base (1) and face a periphery of the dowel passing hole (21) and cutter fixing portions (4) for fixing and adjusting positions of the cutters (3);

wherein several clamping members (9) for fixing the base (1) are arranged on the base (1), the clamping members (9) comprise clamping member fixing blocks (91) arranged on the base (1) and clamping bolts (92) transversely arranged on the clamping member fixing blocks (91), and the clamping bolts (92) are in threaded connection to the clamping member fixing blocks (91);

wherein several fixing block mounting cavities (16) which are provided at different positions and match the clamping member fixing blocks (91) are provided on the base (1), and the clamping member fixing blocks (91) are detachably arranged in the fixing block mounting cavities (16).

* * * * *